United States Patent [19]

Rule

[11] Patent Number: 4,971,125

[45] Date of Patent: Nov. 20, 1990

[54] SHAKE FABRICATING PROCESS

[76] Inventor: Kenneth P. Rule, 1405 E. Emory Rd., Knoxville, Tenn. 37938

[21] Appl. No.: 372,827

[22] Filed: Jun. 29, 1989

[51] Int. Cl.[5] ..... B27M 1/00; B27M 1/08

[52] U.S. Cl. ..... 144/380; 144/3 R; 144/13; 144/43; 144/367; 144/368; 144/376; 144/378; 144/364; 427/297; 427/351

[58] Field of Search ..... 144/3 R, 13, 43, 367, 144/376, 378, 364, 380, 368; 427/297, 351, 376.1, 376.2

[56] References Cited

U.S. PATENT DOCUMENTS

| | | | |
|---|---|---|---|
| 1,499,791 | 7/1924 | Shipley | 427/351 |
| 3,642,042 | 2/1972 | Davidson et al. | 144/380 |
| 4,194,033 | 3/1980 | Motai | 427/351 |
| 4,325,421 | 4/1982 | Janovick et al. | 144/13 |
| 4,337,720 | 7/1982 | Hager | 427/297 |
| 4,343,840 | 8/1982 | Edwards et al. | 427/351 |
| 4,371,572 | 2/1983 | Hager | 427/351 |
| 4,413,024 | 11/1983 | Miyata et al. | 427/351 |
| 4,486,475 | 12/1984 | Shutov et al. | 427/351 |
| 4,637,952 | 1/1987 | Roselund | 427/297 |

*Primary Examiner*—W. Donald Bray
*Attorney, Agent, or Firm*—Pitts and Brittian

[57] ABSTRACT

A shake fabricating process for producing roofing shakes from wood is provided. In accordance with the process a log is stripped of its bark and cut into bolts having a preselected length corresponding to the desired length of the shakes to be produced. The bolts are then cut in half, or in quarters, longitudinally to produce bolt sections which are, in turn, cut into boards having a preselected thickness. A plurality of longitudinally oriented grooves are then cut into the upper and lower surfaces of the boards to give the surfaces the appearance of being hand split, and the boards are cut diagonally from end to end to produce a pair of shakes which decrease in thickness from their first end portions to their second end portions. In order to achieve the desired wood colorization the shakes are then placed in a pressure treating chamber and a first vacuum is generated in the chamber for a preselected time period in order to draw a liquid pigment into the chambers. After the liquid pigment is introduced into the chamber, the chamber is pressurized to atmospheric or slightly higher pressure for a selected period to allow the shakes to become coated with said liquid pigment. The liquid pigment is then drained from the chamber and a second vacuum is generated in the chamber in order to remove any excess pigment from the surface of the shakes.

7 Claims, 3 Drawing Sheets

FIG. 1A
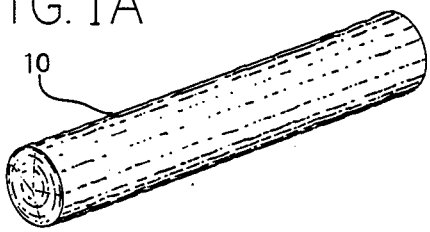
FIG. 1B
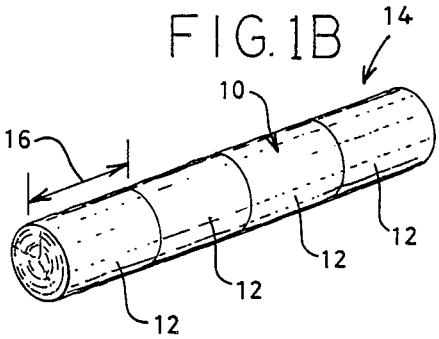
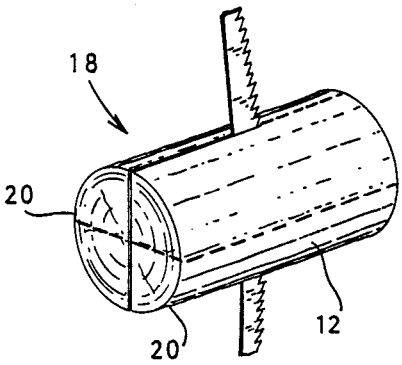
FIG. 1C
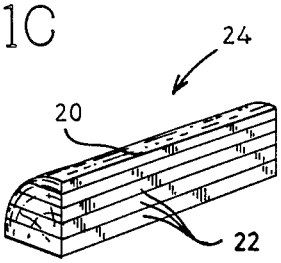
FIG. 1D
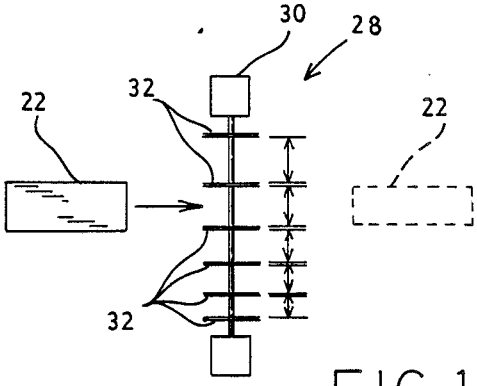
FIG. 1E FIG. 2A
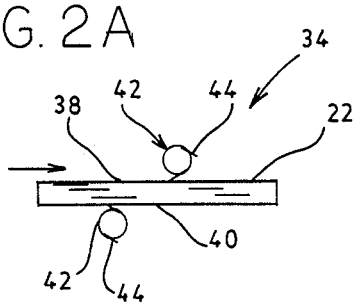
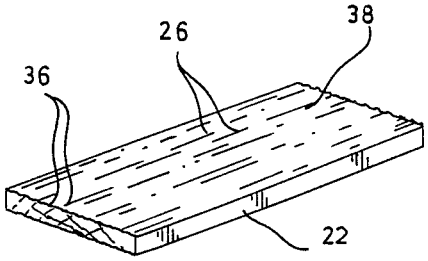
FIG. 2B
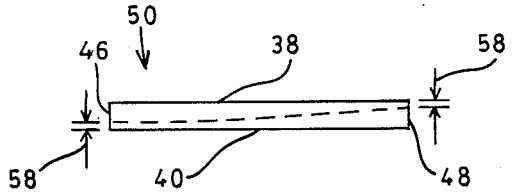
FIG. 2C
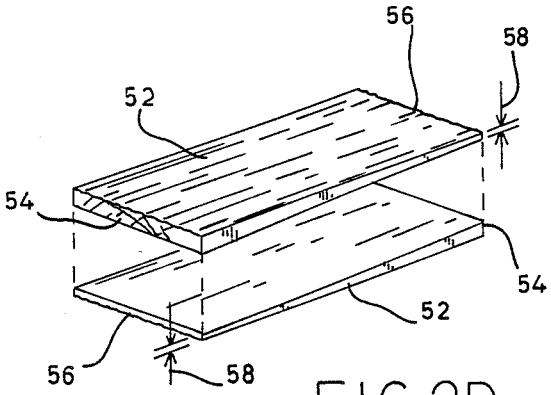
FIG. 2D
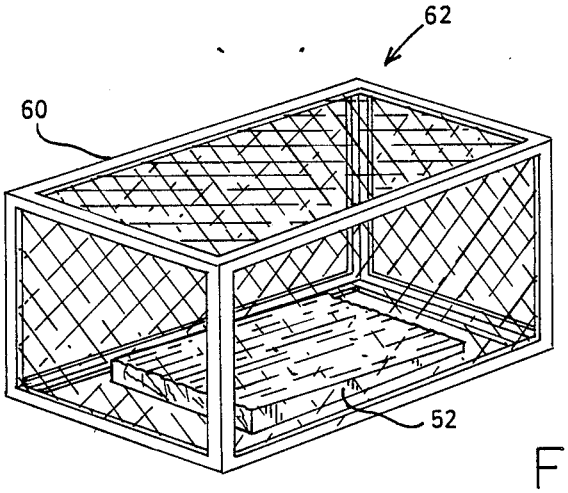
FIG. 2E

SHAKE FABRICATING PROCESS

TECHNICAL FIELD

This invention relates to a process for fabricating roofing shakes from wood and coloring such shakes to obtain a desired appearance. In this particular invention wedge shaped shakes are cut from wooden boards and a pigment is applied in a pressure treating chamber.

BACKGROUND ART

Cedar shakes, have long been a favored roofing material given their pleasing rustic look. However, over the years the supply of cedar has been greatly reduced, and that which is available tends to be expensive and is often of poor quality. Where alternative woods have been utilized the desirable appearance of cedar has been sacrificed. In this regard, split cedar shakes have a distinctive grooved surface and a unique golden brown color which ages to silver-grey. Thus, difficulty has been encountered in reproducing both the surface texture and the colorization of cedar where alternative woods are used. Certain known devices and processes for making shingles or shakes are disclosed in U.S. Letters Patent Nos. 4,291,601; 3,207,192; 3,717,450; 1,910,895; 1,780,097; 1,704,412; 1,683,751; and 1,593,800.

Therefore, it is an object of the present invention to provide a log fabricating process which produces roofing shakes with grooved surfaces which give the shakes the appearance of being hand split or hand hewn.

It is a further object of the present invention to provide a shake fabricating process for coloring shakes, for treating the shakes with preservatives to provide a prolonged life, and for returning the shakes to a natural wood color which is inherently distorted by preservative treatments.

Yet another object of the present invention is to provide a shake fabricating process which produces durable shakes efficiently and at a reasonable cost.

DISCLOSURE OF THE INVENTION

Other objects and advantages will be accomplished by the present invention which provides a shake fabricating process for producing roofing shakes from wood. In accordance with the process a log is stripped of its bark and cut into bolts having a preselected length corresponding to the desired length of the shakes to be produced. The bolts are then cut in half or in quarters longitudinally to produce bolt sections which are, in turn, cut into boards having a preselected thickness. After cutting the boards to the desired width, a plurality of longitudinally oriented grooves are cut into the upper and lower surfaces of the boards to give the surfaces the appearance of being hand split. The boards are then cut diagonally from end to end to produce a pair of shakes which decrease in thickness from their first end portions to their second end portions. In order to achieve the desired wood colorization the shakes are placed in a pressure treating chamber and a first vacuum is generated in the chamber for a preselected time period in order to draw a liquid pigment into the chamber. After the liquid pigment is introduced into the chamber, the chamber is brought back to approximately atmospheric pressure for a selected period to allow the shakes to become coated with the liquid pigment. The liquid pigment is then drained from the chamber, and a second vacuum is generated in the chamber in order to remove any excess pigment from the surface of the shakes. The shakes, remaining within the pressure chamber, can then be pressure treated with a wood preservative chemical to prevent decay and insect damage.

BRIEF DESCRIPTION OF THE DRAWINGS

The above-mentioned features of the present invention will become more clearly understood from the following detailed description of the invention read together with the drawings in which:

FIGS. 1A–E are diagrammatic illustrations of certain steps of the shake fabricating process of the present invention.

FIGS. 2A–E are diagrammatic illustrations of certain steps of the shake fabricating process of the present invention.

BEST MODE FOR CARRYING OUT THE INVENTION

Figure 3A:
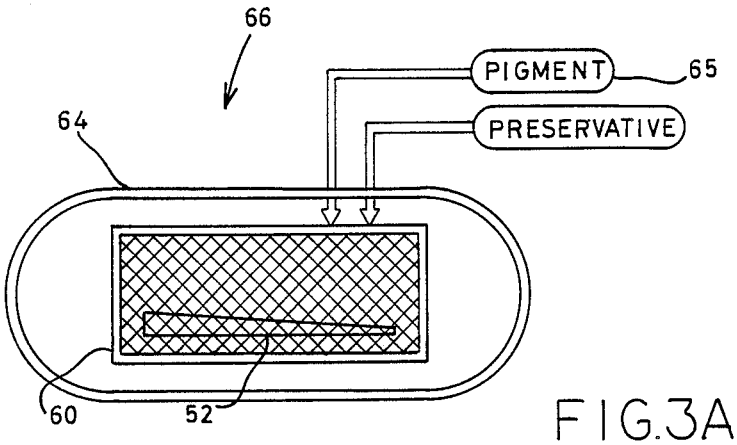
FIGS. 3A–C are diagrammatic illustrations of certain steps of the shake fabricating process of the present invention.
Figure 3B:
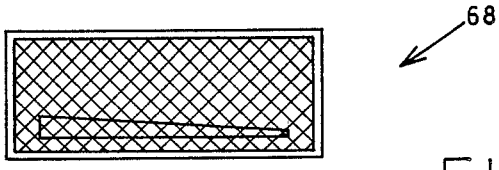
Figure 3C:
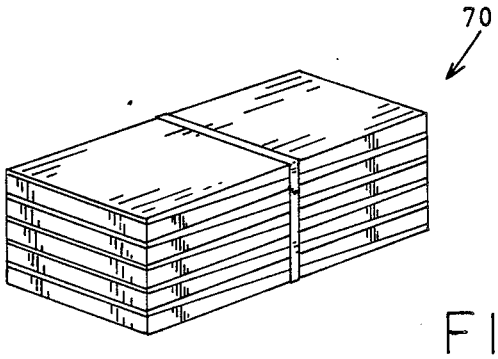

Various steps of a preferred application of the shake fabricating process of the present invention are diagrammatically illustrated in FIGS. 1A–3C. The process utilizes wood as a fabricating material for fabricating the shakes, and a selectively colored pigment is used to alter the color of the wood and/or to alter the distortion of color caused by chemical wood preservatives. In one specific application of the process the wood utilized is pine, and the pigment used is a cedar colored pigment, such that although the shakes produced are fabricated from pine, they have the appearance of traditional cedar roofing shakes. It will, however, be recognized that various types of wood can be used and the pigment used can vary depending on the shake color desired.

Referring now to FIGS. 1A–E and in accordance with a preferred application of the process, a log 10 is first stripped of its bark and cut into sections, or bolts 12, as illustrated at 14. The bolts 12 define a preselected length 16 which, as will become apparent from the discussion below, corresponds to the desired length of the shakes to be produced. As illustrated at 18 each bolt 12 is cut in half lengthwise, preferable on a plane bisecting the axis of the bolt, or, in the case of bolts with substantial diameters, cut into quarters to produce the bolt sections 20. Preferrably this is accomplished using a band type saw rather than the traditional method of splitting the wood in order to avoid the waste of fabricating material. The bolt sections 20 are then cut into boards 22, as illustrated at 24. The boards 22 are then scaled to produce a preselected width which corresponds to the desired width of the shakes to be produced. As illustrated at 28 this can be accomplished by using a multigang rip 30 having a plurality of selectively spaced cutting blades 32, the varied spacing between the blade 32 corresponding to various preferred shake widths.

As illustrated at 34 in FIG. 2A, the next step in the preferred process is the cutting of longitudinal grooves 36 in both the upper and lower surfaces 38 and 40, respectively, of the boards 22 to give the surfaces the appearance of having been split, rather than cut, from the log 10. This can be accomplished using a surfacer 42 having uneven blades 44. Each of the boards 22 is then cut diagonally from its first end 46 to its second end 48, as illustrated at 50, to produce a pair of shakes 52 defining decreasing thicknesses from their first end portions 54 to their second end portions 56. It will be noted that the diagonal cut is made such that the end portions 56 define a thickness 58 sufficient to provide the requisite durability, the preferred thickness being approximately one eighth of an inch. The shakes 52 are then placed in a basket 60 and allowed to dry as illustrated at 62. Whereas for purposes of illustration only one shake 52 is depicted in the basket 60, it will be recognized that a plurality of shakes 52 can be placed in the basket 60 for drying.

Once the shakes 52 have been dried they are placed in a pressure treating chamber 64 as illustrated at 66 in FIG. 3A. As illustrated, the shakes can remain in the basket 60 if desired to facilitate ease of handling. Utilizing suitable vacuum generating means (not shown) a first vacuum is then produced within the chamber 64 and maintained for a selected period of time in order to draw liquid pigment of a preselected color from the reservoir 65 into the chamber 64. Generally, only a slight vacuum is necessary to draw the pigment into the chamber. When the desired amount of pigment has been introduced, the vacuum is terminated and the pressure within the chamber is returned to approximately atmospheric pressure for a preselected period as the shakes are allowed to become coated with the liquid pigment. Such preselected period is generally a period of approximately five minutes, but, depending upon the wood fabricating material used for fabricating the shakes, and the type of pigment used, the length of the time period can vary.

After the shakes have been coated with pigment, the liquid pigment is drained from the chamber 64, and a second strong vacuum is applied to the chamber to remove any excess pigment from the surface of the shakes. The shakes can then be pressure treated with one or more conventional chemical wood preservatives without being removed from the chamber, the preservatives serving to extend the useful life of the shakes. After pressure treatment of the shake with preservatives the shakes are removed from the chamber 64 as illustrated at 68, and can be packaged or bound, as illustrated at 70, for shipment and/or sale.

In an alternate application of the process of the present invention the pressure within the chamber 64 is rapidly increased to a preselected pressure greater than atmospheric pressure upon termination of the first vacuum and the chamber is maintained at such elevated pressure for a preselected period of time. It will be recognized that this elevated pressure causes the liquid pigment to impregnate the wood of the shakes rather than simply coat the surface area. Of course, as a result the shakes tend to maintain the desired color for a longer period of time. However, it will be appreciated that where high pressure values are used more liquid pigment impregnates the wood of the shakes, and a great deal more pigment is used, thus, increasing manufacturing costs. Therefore, it may be desirable to restrict pressurization within the chamber to fairly low values, for example, approximately 5 pounds per square inch.

In light of the above it will be recognized that the process of the present invention produces a shake which has the appearance of a traditional hand hewn or hand split shake, and ages uniformly and bleaches to a natural wood color. Moreover, when a pigment such as a cedar pigment is used on pine fabricating materials, the shakes not only give the appearance of natural wood immediately after being manufactured, but tend to age to a silver-grey tone as is the case with cedar shakes. Further, the process provides for efficient use of fabricating materials with very little waste, and inexpensively produces strong, durable shakes.

While a preferred application of the shake fabricating process of the present invention has been shown and described, it will be understood that there is no intent to limit the invention to such disclosure, but rather it is intended to cover all modifications and alternative applications falling within the spirit and scope of the invention as defined in the appended claims.

I claim:

1. A shake fabricating process for producing roofing shakes from a board fabricated from wood, said board having first and second oppositely disposed outer surfaces and first and second ends, said board further defining first and second longitudinal edges extending from said first end to said second end, said fabricating process comprising the steps of:

cutting a plurality of longitudinally oriented grooves in said first and second outer surfaces, whereby said first and second surfaces are provided with the appearance of being hand split;

cutting said board on a diagonal plane relative to said first and second surfaces, said plane extending from said first end to said second end and from said first edge to said second edge so as to divide said board into a pair of shakes, each said shake having a first and second end portion and defining a decreasing thickness from said first and portion to said second end portion; placing said shakes in a pressure treating chamber;

generating a first vacuum within said chamber to draw a liquid pigment into said chamber;

pressurizing said chamber to substantially atmospheric pressure for a preselected period to allow said shakes to become coated with said pigment, draining said liquid pigment from said chamber; and generating a second vacuum within said chamber for a preselected period to pull any excess pigment from the surface of said shakes to facilitate drying of said shake.

2. The shake fabricating process of claim 1 and after the step of generating said second vacuum, wherein said process comprises the further step of pressure treating said shakes within said chamber with a chemical wood preservative, whereby the coating of said shakes with said pigment prior to said pressure treatment with said preservatives facilitates the counter action of the distortion of color caused by said chemical preservatives.

3. The shake fabricating process of claim 1 wherein said step of cutting a plurality of grooves is accomplished by using at least one surface planer having uneven blades whereby said grooves are simultaneously cut in said first surface.

4. The shake fabricating process of claim 3 wherein said step of cutting said grooves is accomplished by using a pair of said surface planers whereby said grooves are cut in said first and second surfaces simultaneously.

5. A shake fabricating process for producing roofing shakes from a log, said fabricating process comprising the steps of:

removing the bark from said log;

cutting said log into bolts having a preselected length;

cutting each said bolt longitudinally to produce at least two bolt sections;

cutting said bolt sections into boards having a preselected thickness;

scaling said boards such that said boards define a preselected width by longitudinally cutting each said board, whereby each said board has first and second oppositely disposed outer surfaces and first and second ends, each said board further defining first and second longitudinal edges extending from said first end to said second end of said board;

cutting a plurality of longitudinally oriented grooves in said first and second outer surfaces of each said board, whereby said first and second surfaces are provided with the appearance of being hand split;

cutting each said board on a diagonal plane relative to said first and second surfaces, said plane extending from said first end to said second end and from said first edge to said second edge so as divide each said board into a pair of shakes, each said shake having a first and second end portion and defining a decreasing thickness from said first end portion to said second end portion;

placing said shakes in a pressure treating chamber;

generating a first vacuum within said chamber to draw a liquid pigment into said chamber;

pressurizing said chamber to substantially atmospheric pressure for a preselected period to allow said shakes to become coated with said pigment;

draining said liquid pigment from said chamber;

generating a second vacuum within said chamber for a preselected period to pull any excess pigment from the surface of said shakes to facilitate drying of said shakes; and pressure treating said shakes within said chamber with a chemical wood preservative.

6. The fabricating process of claim 5 wherein said step of cutting said bolt to produce bolt sections is accomplished by using a band type saw to provide a uniform, square surface whereby waste of said wood fabricating material is avoided.

7. The fabricating process of claim 5 wherein said step of scaling said board is accomplished using a multigang rip saw provided with a plurality of selectively spaced blades, the spacing between said blades corresponding to said preselected width of said boards.

* * * * *

UNITED STATES PATENT AND TRADEMARK OFFICE

CERTIFICATE OF CORRECTION

PATENT NO. : 4,971,125

DATED : November 20, 1990

INVENTOR(S) : Kenneth P. Rule and Hugh E. Rule

It is certified that error appears in the above-identified patent and that said Letters Patent is hereby corrected as shown below:

On the title page, item [76] Inventor: please add the following:

-- Hugh E. Rule
1520 Courtney Oaks Lane
Knoxville, Tennessee 37938 --.

Signed and Sealed this

Sixth Day of October, 1992

*Attest:*

DOUGLAS B. COMER

*Attesting Officer*

*Acting Commissioner of Patents and Trademarks*